US005194090A

United States Patent [19]

Tajiri et al.

[11] Patent Number: 5,194,090

[45] Date of Patent: Mar. 16, 1993

[54] LIQUID PIGMENT COMPOSITION, AND MASTER-COLORED POLYAMIDE YARN MADE BY USING SAME

[75] Inventors: Koji Tajiri; Hiroyoshi Minematsu; Teruhiko Adachi, all of Mihara, Japan

[73] Assignee: Teijin Limited, Osaka, Japan

[21] Appl. No.: 717,574

[22] Filed: Jun. 19, 1991

[30] Foreign Application Priority Data

Jun. 20, 1990 [JP] Japan ..... 2-159646

[51] Int. Cl.[5] ..... D01F 1/04

[52] U.S. Cl. ..... 106/499; 106/400; 106/401; 106/493; 106/311; 8/512; 8/516; 8/637.1; 8/924; 252/351; 252/356; 428/395

[58] Field of Search ..... 106/400, 401, 493, 499, 106/311; 252/351, 356; 8/512, 516, 924, 637.1; 428/395

[56] References Cited

U.S. PATENT DOCUMENTS

| | | | |
|---|---|---|---|
| 4,265,632 | 5/1981 | Papenfuhs et al. | 8/512 |
| 4,450,200 | 5/1984 | Iwato et al. | 428/323 |
| 4,450,304 | 5/1984 | Diery et al. | 106/499 |
| 4,759,801 | 7/1988 | Goldmann et al. | 106/499 |
| 4,767,465 | 8/1988 | Nakamura et al. | 106/499 |

*Primary Examiner*—Mark L. Bell
*Assistant Examiner*—Scott L. Hertzog
*Attorney, Agent, or Firm*—Armstrong, Westerman, Hattori, McLeland & Naughton

[57] ABSTRACT

A liquid pigment composition for master-coloring polyamides is described, which is comprised of a pigment and a pigment dispersant composed of a polymeric material selected from liquid polyesters and a liquid polyether esters, each having a hydroxyl value of 30 to 120 mg.KOH/g. The amount of the pigment dispersant is usually 30 to 3,000 parts by weight per 100 parts by weight of the pigment. A master-colored polyamide yarn also is described which contains, based on the weight of the yarn, 0.01 to 2% by weight of a pigment ingredient and up to 6% by weight of the above-mentioned pigment dispersant.

5 Claims, No Drawings

LIQUID PIGMENT COMPOSITION, AND MASTER-COLORED POLYAMIDE YARN MADE BY USING SAME

BACKGROUND OF THE INVENTION (1) Field of the Invention

This invention relates to a liquid pigment composition for master-coloring (i.e., spin-dyeing) polyamides, and to a master-colored polyamide yarn made by master-coloring a polyamide with the same. More particularly, the present invention relates to a liquid pigment having a good compatibility with a polyamide, and also to a master-colored polyamide yarn made by using this liquid pigment.

(2) Description of the Related Art

In general, master-colored yarns have been valuably used for ordinary clothing and industrial materials widely in various fields because of the merit that the subsequent dyeing step can be omitted. In addition, master-colored yarns have an excellent weathering fastness and therefore the demand for master colored yarns has recently been increasing.

In the field of ordinary clothing and industrial materials, master-colored polyamide yarns are seldom used with a single color alone, and various kinds of master-colored yarns having different colors are required. As the means for satisfying this requirement, there has been adopted a method of adding a master batch of a coloring material to a polyamide.

This master batch addition method requires, however, cleaning of a material supply system and washing of an extruder and conduits at the step of changeover of the color, and the master batch addition method has a problem in that the productivity is inevitably reduced.

A proposal of an injection method has been made mainly on polyester fibers, instead of the master batch addition method. In the injection method, a liquid pigment dispersant (colorant) is supplied from the midway of a melting apparatus so as to effect the changeover without contamination of the extruder with the pigment dispersant (see, for example, Japanese Unexamined Patent Publication No. 58-149311, 60-45689, 60-45690, 63-92719 and 63-117071).

Liquid pigment dispersants described in these prior art references are liquid at normal temperatures, and low-molecular-weight polyesters and polyethers having a number average molecular weight of 1,000 to 4,000 are specifically mentioned as examples. These liquid pigment dispersants are, however, used exclusively for polyesters and polypropylene, and if these dispersants are incorporated in polyamides, since these dispersants have a polarity different from that of polyamides, the dispersants separate from the polyamide at the melt spinning step, i.e., bleed out, and bending of the filamentary extrudate occurs, with the result that no satisfactory operational perfarmance is attained.

Another proposal has been made in which a pigment dispersant of a liquid polyether or polyether-ester type having a hydroxyl value (OH value) below 25 mg KOH/g and thus an improved heat resistance is used for master-coloring polyesters (see Japanese Unexamined Japanese Patent Publication No. 63-120767 and 01-118678). Where this pigment dispersant is used for master-coloring polyamides, since the dispersant has no compatibility with polyamides, the dispersant separates from the polyamides and is difficult to add in an amount sufficient for the master coloration, and therefore, the dispersant of this type is of no practical use for master-coloring polyamides.

Still another proposal has been made in which a liquid pigment dispersant comprised of an isoindolinone pigment and a metal salt of stearic acid is used for master-coloring polyamides (see Japanese Unexamined Patent Publication No. 63-92717). This particular liquid pigment dispersant cannot widely be applied to polyamides.

A further proposal has been made in which a liquid pigment dispersant comprising a low-molecular-weight polyamide dispersant and having a good compatibility with a polyamide is used for master-coloring a polyamide. The liquid pigment dispersant of this type does not have a heat resistance sufficient to resist the melt spinning and is of no practical use.

More specifically, a liquid pigment dispersant to be used exclusively for polyamides has heretofore not been developed, as set forth on page 2, right upper column, lines 5–8 of Japanese Unexamined Patent Pulication No. 63-92717, and at present a colored polyamide yarn is not commercially produced, which is master-colored with a liquid pigment commercially available for master coloration of polyamides.

SUMMARY OF THE INVENTION

Under the above-mentioned background, a primary object of the present invention is to provide a liquid pigment composition for master-coloring ordinary polyamides, which has a good compatibility with polyamides and is capable of producing master-colored polyamide yarns having various colors and exhibiting a good spinning stability, with a good productivity, and to provide a master-colored polyamide yarn made by using this liquid pigment composition.

In accordance with one aspect of the present invention, there is provided a liquid pigment composition for master-coloring polyamides, comprising a pigment dispersant and a pigment dispersed in the dispersant, said pigment dispersant comprising at least one polymeric material selected from the group consisting of liquid polyesters and liquid polyether esters, which have a hydroxyl value of 30 to 120 mg.KOH/g.

In accordance with another aspect of the present invention, there is provived a master-colored polyamide yarn containing, based on the weight of the yarn, 0.01 to 2% by weight of a pigment ingredient and up to 6% by weight of the above-mentioned pigment dispersant.

DETAILED DESCRIPTION OF THE PREFERRED EMBODIMENTS

The above-specified liquid polyesters and liquid polyether esters are used as the pigment dispersant (i.e., vehicle) in the liquid pigment composition of the present invention. These liquid polyesters and liquid polyether esters may be used either alone or in combination. In some cases, other pigment dispersants can be used in combination with the liquid polyesters and liquid polyether esters.

The main constituent of the liquid polyester used in the present invention is a polycondensation product of an aliphatic dicarboxylic acid or alicyclic dicarboxylic acid such as adipic acid, sebacic acid, azelaic acid, glutaric acid or hydrogenated phthalic acid with a glycol such as ethylene glycol, propylene glycol or butylene glycol.

As the dicarboxylic acid, an aliphatic dicarboxylic acid having 3 to 8 carbon atoms, especially adipic acid, is preferable. An alicyclic dicarboxylic acid having 4to 12 carbon atoms is also used. Together with the aliphatic or alicyclic dicarboxylic acid, an aromatic dicarboxylic acid such as terephthalic acid, isophthalic acid or orthoisophthalic acid, a univalent carboxylic acid such as coconut oil fatty acid, oleic acid or lauric acid, or a trivalent or higher polyvalent carboxylic acid such as trimellitic acid or pyromellitic acid, can optionally be used in combination.

As the glycol, a glycol having 2 to 6 carbon atoms, especially propylene glycol or butylene glycol, is preferably used. Together with the glycol, a monohydric alcohol such as n-octyl alcohol, iso-octyl alcohol or n-nonyl alcohol, or a polyhydric alcohol such as glycerol, pentaerythritol or sorbitol, can optionally be used according to need. To provide a polyester having an enhanced hydroxyl (OH) value, it is preferable that a polyhydric alcohol is used in combination with the glycol.

The liquid polyester used in the present invention must have a hydroxyl (OH) value of from 30 to 120 mg.KOH/g, preferably from 35 to 80 mg.KOH/g. If the OH value is smaller than 30 mg.KOH/g, the liquid polyester cannot be used as a general-purpose pigment dispersant which is used exclusively for polyamides. In contrast, if the OH value exceeds 120 mg.KOH/g, the heat resistance of the polyester is reduced.

The polyester having the above-specified OH value can be obtained by using an excess of the glycol or other alcohol over that required for equimolar addition to the acid or enhancing the proportion of the polyhydric alcohol in the alcohol ingredient. For example, if the alcohol ingredient is used in an amount of 1.1 to 2.0 moles, preferably 1.2 to 1.5 moles, per mole of the acid ingredient, a liquid polyester having the desired OH value can easily be prepared.

The thus-prepared liquid polyester can be modified for controlling the viscosity or improving the dispersibility. For example, the polyester is treated with a diisocyanate whereby the diisocyanate is reacted with hydroxyl groups of the polyester and thus bonded to the polyester. As the diisocyanate, there can be mentioned, for example, 2,4-tolylene diisocyanate and hexamethylene diisocyanate.

The liquid polyether ester which is the other type of the pigment dispersant used in the present invention is a polymer prepared by polycondensation of a dicarboxylic acid with a glycol ingredient predominantly comprised of a polyoxyalkylene glycol, which has recurring units represented by the following formula:

$$+\overset{O}{\overset{\|}{C}}-R'-\overset{O}{\overset{\|}{C}}-O-(R''-O)_n+$$

wherein R' represents an alkylene or arylene group having 2 to 15 carbon atoms, R'' represents an alkylene group having 1 to 7 carbon atoms, and n is an integer of from 2 to 20.

As the dicarboxylic acid, there can be mentioned, for example, aliphatic dicarboxylic acids such as malonic acid, succinic acid, adipic acid, pimellic acid, azelaic acid and sebacic acid, and aromatic dicarboxylyc acids such as phthalic acid, isophthalic acid, terephthalic acid and naphthalene-dicarboxylic acid. Of these dicarboxylic acids, an aliphatic dicarboxylic acid having 3 to 8 carbon atoms, especially adipic acid, is preferably used.

As the polyoxyalkylene glycol, there can be mentioned, for example, poly(oxyethylene) glycol and poly(oxypropylene-oxyethylene) glycol. The molecular weight of the polyoxyalkylene glycol is not larger than 2,000, preferably from about 80 to about 1,000. From the viewpoint of the heat resistance, a low-molecular-weight glycol such as diethylene glycol or triethylene glycol is advantageously used as the polyoxyalkylene glycol ingredient.

The liquid polyether ester used in the present invention must have a hydroxyl (OH) value of from 30 to 120 mg.KOH/g, preferably 35 to 80 mg.KOH/g, in view of the dispersibiliyty in polyamides, as in the case of the above-mentioned liquid polyester. If the OH value is smaller than 30 mg.KOH/g, the liquid polyether ester is not suitable as a general-purpose pigment dispersant which is exclusively used for polyamides. In contrast, if the OH value exceeds 120 mg.KOH/g, the heat resistance of the polyether ester is reduced.

As in the case of the above-mentioned liquid polyester, the polyether ester having the above-specified OH value can be obtained by using an excess of the polyoxyalkylene glycoll over that required for equimolar addition to the acid ingredient.

To control the OH value, together with the above-mentioned polyoxyalkylene glycol, a monohydric alcohol such as n-octyl alcohol, iso-octyl alcohol or n-nonyl alcohol, a dihydric alcohol such as ethylene glycol, 1,3-propylene-diol or 1,4-butane-diol, or a polyhydric alcohol such as trimethylolpropane, glycerol, pentaerythritol, dipentaerythritol or sorbitol, can optionally be used according to need.

The number average molecular weight of the pigment dispersant used in the present invention is preferably from 1,000 to 8,000, more preferably from 1,500 to 5,000. If the number average molecular weight of the pigment dispersant is lower than 1,000, the heat resistance of the master-colored polyamide is reduced. In contrast, if the number average molecular weight exceeds 8,000, the viscosity of the pigment dispersant is large and the amount of the pigment to be incorporated is inevtably reduced, and therefore, the desired master coloration is difficult to attain.

The kind of the pigment used in the present invention is not particularly limited, and ordinary pigments widely used in the art can be used. For example, there can be mentioned organic pigments such as azo pigments, phthalocyanine pigments, perilene pigments, perinone pigments and anthraquinone pigments, and inorganic pigments such as carbon black, red iron oxide, Prussian blue and titanium oxide. These pigments may be used either alone or as mixtures of two or more thereof or mixtures thereof with a dye.

In the liquid pigment composition for master-coloring polyamides according to the present invention, the ratio of the pigment dispersant to the pigment is such that the amount of the pigment dispersant is from 30 to 3,000 parts by weight, preferably 50 to 2,000 parts by weight, per 100 parts by weight of the pigment. If the amount of the pigment dispersant is smaller than 30 parts by weight, the viscosity of the liquid pigment is too high and handling of the pigment is difficult. In contrast, if the amount of the pigment dispersant exceeds 3,000 parts by weight, the tinting power is reduced and the fiber spinnability is degraded.

The viscosity of the liquid pigment composition for master-coloring polyamides, prepared by incorporating the pigment with the pigment dispersant, is preferably from 10 to 2,000 poises at 25° C. and more preferably 100 to 1,500 poises at 25° C. If the viscosity of the liquid pigment composition is lower than 10 poises, the pigment tends to separate easily from the pigment dispersant. In contrast, if the viscosity exceeds 2,000 poises, the liquid pigment composition becomes difficult to handle and the productivity is reduced.

To improve the weatherability of polyamides, a copper compound such as copper iodide (CuI) may be incorporated in the liquid pigment composition of the present invention. The amount of the copper compound incorporated is preferably such that the copper content in the master-colored polyamide yarn is about 30 ppm to about 50 ppm by weight. If desired, a copper-precipitation-preventing agent such as potassium iodide or 2-mercaptobenzimidazole can be added in combination with the copper compound to the liquid pigment composition of the present invention to further improve the weatherability of the polyamide yarn. The amount of the copper-precipitation-preventing agent is preferably larger than the amount equimolar to the cooper compound.

Furthermore, a lubricant such as magnesium stearate or ethylene-bis-stearoamide can be added, if dsired. The amount of the lubricant is preferably such that the content of the lubricant in the polyamide yarn is from about 0.1 to about 0.5% by weight.

The above-mentioned additives can be added at any step, but preferably added into the pigment dispersant in view of simplicity of the production process, although they may be added separately and independently.

The liquid pigment composition for master-coloring polyamide can be prepared by a conventional procedure, for example, by mixing and kneading the pigment dispersant, the pigment and the additives together by a kneader or another similar aparatus.

The preparation of a master-colored polyamide yarn by using the liquid pigment composition of the present invention can be accomplished according to conventional procedures. For example, the liquid pigment is injected into a molten polyamide in a conduit by using a gear pump, the molten polymer mixture is kneaded by using a static mixer, and the kneaded molten polymer composition extruded into a fibrous extrudate through a spinneret, and the fibrous extrudate is cooled, drawn and after-finished to yield a mater-colored polyamide yarn.

In the master-colored polyamide yarn, the content of the pigment in the yarn is preferably from 0.01 to 2% by weight and more preferably 0.1 to 1.5% by weight, and the content of the pigment dispersant in the yarn is up to 6% by weight and more preferably from 0.1 to 3.0% by weight, based on the weight of the yarn. If the content of the pigment is smaller than 0.01% by weight, the tinting power is poor, and if the contnent of the pigment exceeds 2% by weight, a satisfactory spinning performance cannot be attained. If the content of the pigment dispersant in the polyamide yarn exceeds 6% by weight, the spinning performance becomes poor.

The pigment dispersant used in the present invention is characterized as possesing a large proportion of hydroxyl groups and exhibiting an enhanced compatibility with polyamides, and therefore, deeply colored polyamide yarns can be obtained.

The present invention will now be described more specifically with reference to the following examples. In the examples, "parts" and "%" are by weight unless otherwise specified.

The hydroxyl (OH) values occurring in the examples were determined as follows. One gram of the sample was acetylated, and the amount of potassium hydroxide required for neutralizing the acetic acid generated from the acetylated product was measured by the Jefferson method. The OH value was expressed by the measured amount in mg of potassium hydroxide.

Examples 1 through 5 and Comparative Examples 1 through 3

An aliphatic carboxylic acid was reacted with a diol wherein the amount of the diol was varied to control the OH value and thus to prepare various liquid pigment dispersants as follows.

In Example 1, 1.3 moles of 1,4-butylene gloycol was incorporated with 1 mole of adipic acid and the mixture was subjected to polycondensation to prepare a liquid polyester having a number average molecular weight of 2,300 and an OH value of 45 mg.KOH/g.

In Example 2, 0.5 mole of ethylene glycol and 0.8 mole of diethylene glycol were incorporated with 1 mole of adipic acid and the mixture was subjected to polycondensation to prepare a liquid polyether ester having a number average molecular weight of 2,400 and an OH value of 40 mg.KOH/g.

In Example 3, 0.8 mole of poly(oxyethylene) glycol having a molecular weight of 600 and 0.6 mole of ethylene glycol were incorporated with 1 mole of adipic acid and the mixture was subjected to polycondensation to prepare a liquid polyether ester having a number average molecular weight of 2,200 and an OH value of 47 mg.KOH/g.

In Example 4, 1.5 moles of 1,4-butylene glycol was incorporated with 1 mole of adipic acid and the mixture was subjected to polycondensation to prepare a liquid polyester having a number average molecular weight of 1,100 and an OH value of 110 mg.KOH/g.

In Example 5, 1.1 moles of 1,3-butylene glycol and 0.04 mole of glycerol were incorporated with 1 mole of adipic acid and the mixture was subjected to polycondensation to prepare a liquid polyester having a number average molecular weight of 5,000 and an OH value of 32 mg.KOH/g.

In Comparative Example 1, 0.8 mole of 1,4-butylene glycol and 0.4 mole of 2-ethylhexyl alcohol were incorporated with 1 mole of adipic acid and the mixture was subjected to polycondensation to prepare a liquid polyester having a number average molecular weight of 2,600 and an OH value of 4 mg.KOH/g.

In Comparative Example 2, 0.8 mole of ethylene glycol, 0.4 mole of polyoxyethylene glycol having a molecular weight of about 600 and 0.05 mole of glycerol were incorporated with 1 mole of adipic acid and the mixture was subjected to polycondensation to prepare a liquid polyether ester having a number average molecular weight of 2,000 and an OH value of 140 mg.KOH/g.

In Comparative Example 3, 0.7 mole of 1,4-butylene glycol and 0.4 mole of diethylene glycol were incorporated with 1 mole of adipic acid and the mixture was subjected to polycondensation to prepare a polyether ester having a number average molecular weight of 8,000 and an OH value of 17 mg.KOH/g.

In 70 parts of each of the thus-prepared polyester or polyether ester pigment dispersants were incorporated 20 parts of an organic pigment (Phthalocyanine Green) and 10 parts of an inorganic pigment (titanium yellow pigment) to prepare a liquid pigment composition containing the pigments at a concentration of 30%.

The thus-prepared liquid pigment composition was injected into a molten polyamide at the melt spinning step to prepare a master-colored polyamide yarn as follows. The liquid pigment composition was injected through a gear pump into a molten polyamide in a conduit and the pigment-incorporated polyamide was kneaded by using a static mixer (Kennix type 40 stage static mixer). The polyamide mixture was melt-extruded through a spinneret having 68 orifices of a triangular section providing a hollow fiber at 245° C., and the fibrous extrudate was continuously drawn, crimped and wound to obtain a master-colored polyamide yarn composed of 68 filaments and having 1,300 deniers in total. The polyamide used was a nylon-6 polymer having an intrinsic viscosity of 1.34.

The amount of each liquid pigment composition was varied stepwise from 1% to 6% to evaluate the potential of the pigment dispersant based on the highest concentration attainable without phase separation. The results are shown in Table 1.

In Table 1, the spinning performanse was judged based on whether or not bending or kneeling of the fibrous extrudate from the orifice occurred, or whether or not breaking of the fibrous extrudate wall occurred to render formation of the hollow structure impossible. The spinning performance was expressed by the following three stages.

A: good

B: bad

C: very bad

The yarn breakage was expressed as the average frequency of yarn breaks per 5 kg of the completely wound doffing in percents.

TABLE 1

| | Example 1 | | | Example 2 | | | Example 3 | | |
|---|---|---|---|---|---|---|---|---|---|
| Alcohol & amount (moles/mole of acid) | 1,4-Butylene glycol (1.3) | | | Ethylene glycol (0.5) + diethylene glycol (0.8) | | | Polyethylene glycol [600] (0.8) + ethylene glycol (0.6) | | |
| Molecular weight | 2,300 | | | 2,400 | | | 2,200 | | |
| OH value (mg · KOH/g) | 45 | | | 40 | | | 47 | | |
| Amount of liquid pigment (%) | 2.0 | 4.0 | 6.0 | 2.0 | 4.0 | 6.0 | 2.0 | 4.0 | 6.0 |
| Pigment concentration (%) | 0.6 | 1.2 | 1.8 | 0.6 | 1.2 | 1.8 | 0.6 | 1.2 | 1.8 |
| Pigment dispersant concentration (%) | 1.4 | 2.8 | 4.2 | 1.4 | 2.8 | 4.2 | 1.4 | 2.8 | 4.2 |
| Spinning performance | A | A | A | A | A | A | A | A | A |
| Yarn breakage (%) | 0.8 | 1.0 | 1.1 | 0.9 | 0.9 | 1.2 | 0.8 | 1.0 | 1.3 |

| | Example 4 | | | Example 5 | | | Comp. Example 1 | | |
|---|---|---|---|---|---|---|---|---|---|
| Alcohol & amount (moles/mole of acid) | 1,4-Butylene glycol (1.5) | | | 1,3-Butylene glycol (1.1) + glycerol (0.04) | | | 1,4-Butylene glycol (0.8) + 2-ethylhexyl alcohol (0.4) | | |
| Molecular weight | 1,100 | | | 5,000 | | | 2,600 | | |
| OH value (mg · KOH/g) | 110 | | | 32 | | | 4 | | |
| Amount of liquid pigment (%) | 2.0 | 4.0 | 6.0 | 2.0 | 3.0 | 4.0 | 1.0 | 2.0 | 3.0 |
| Pigment concentration (%) | 0.6 | 1.2 | 1.8 | 0.6 | 0.9 | 1.2 | 0.3 | 0.6 | 0.9 |
| Pigment dispersant concentration (%) | 1.4 | 2.8 | 4.2 | 1.4 | 2.1 | 2.8 | 0.7 | 1.4 | 2.1 |
| Spinning performance | A | A | A | A | A | A | B | C | C |
| Yarn breakage (%) | 1.2 | 1.4 | 1.6 | 0.8 | 0.9 | 0.9 | 6.9 | *1 | *1 |

| | Comp. Example 2 | | | Comp. Example 3 | | |
|---|---|---|---|---|---|---|
| Alcohol & amount | PEG[600]*2 (0.4) + glycerol (0.05) + ethylene glycol (0.8) | | | 1,4-Butylene glycol (0.7) + diethylene glycol (0.4) | | |
| Molecular weight | 2,000 | | | 8,000 | | |
| OH value (mg · KOH/g) | 140 | | | 17 | | |
| Amount of liquid pigment (%) | 2.0 | 4.0 | 6.0 | 1.0 | 2.0 | 3.0 |
| Pigment concentration (%) | 0.6 | 1.2 | 1.8 | 0.3 | 0.6 | 0.9 |
| Pigment dispersant concentration (%) | 1.4 | 2.8 | 4.2 | 0.7 | 1.4 | 2.1 |
| Spinning performance | B | B | C | B | B | C |
| Yarn breakage (%) | 4.7 | 9.8 | 18.9 | 5.6 | 9.7 | *1 |

Note

*1Impossible to spin

*2Polyethylene glycol

As is apparent from the results shown in Table 1, the liquid pigment composition of the present invention has a good compatibility with a polyamide, and therefore, master-colored polyamide yarns prepared by using the liquid pigment of the present invention had a very dense color, could be spun very smoothly and exhibited very good weatherability and washing fastness. The liquid pigment composition of the present invention is suitable for preparing master-colored ordinary polyamide yarns of various colors with a high spinning stability and a high productivity.

In contrast, in the case of the liquid pigment composition comprising the conventional pigment dispersant, since the compatibility with a polyamide was poor, the pigment dispersant separated from the fibrous extrudate extruded from the spinning orifice to contaminate the spinning orifice surface or make the flow of the fibrous extrudate uneven, and it was impossible to disperse the desired amount of pigment. Accordingly, it was impossible to impart a dese color to the master-colored polyamide yarn.

In Comparative Example 2 wherein the OH value of the pigment dispersant is high, i.e., 140 mg.KOH/g, although the compatibility of the pigment dispersant with the polyamide was good, since the heat-resisting temperature of the pigment dispersant was lower than 260° C., decomposition and thus bubbling occurred during the melt spinning operation and the spinning performance was very bad.

In Comparative Example 3 wherein the molecular weight of the pigment dispersant is high, i.e., 8,000, the viscosity thereof was high and the handling was difficult. In addition, since the OH value of the pigment dispersant was as small as 17 mg.KOH/g, the compatibility with the polyamide was poor, and the spinning performance was bad and yarn breakage frequently occurred.

What is claimed is:

1. A master-colored polaymide yarn containing, based on the weight of the yarn, 0.01 to 2% by weight of a pigment ingredient and up to 6% by weight of a pigment dispersant, said pigment dispersant comprising at least one polymeric material selected from the group consisting of polyesters and polyether esters, which have a hydroxyl value of 30 to 120 mg.KOH/g.

2. A master-colored polyamide yarn according to claim 1, which contains, based on the weight of the yarn, 0.1 to 1.5% by weight of the pigment ingredient and 0.1 to 3.0% by weight of the pigment dispersant.

3. A master-colored polyamide yarn according to claim 1, wherein the polyester is a polycondensation product of an acid ingredient predominantly comprised of a dicarboxylic acid selected form the group consisting of aliphatic dicarboxylic acid having 3 to 8 carbon atoms and alicyclic dicarboxylic acids having 4 to 12 carbon atoms, with an alcohol ingredient predominantly comprised of a glycol having 2 to 6 carbon atoms.

4. A master-colored polyamide yarn according to claim 1, wherein the polyether ester is a polycondensation product predominantly comprised of recurring units represented by the formula:

$$\left[\overset{O}{\overset{\|}{C}}-R'-\overset{O}{\overset{\|}{C}}-O-(R''-O)_n\right]$$

wherein R' represents an alkylene or arylene group group having 2 to 15 carbon atoms, R'' represents an alkylene group having 1 to 7 carbon atoms, and n is an integer of from 2 to 20.

5. A liquid pigment composition according to claim 1, wherein the liquid polyesters and liquid polyether esters have a hydroxyl value of 35 to 80 mg.KOH/g.

* * * * *